US007521643B2

(12) United States Patent
Liu

(10) Patent No.: US 7,521,643 B2
(45) Date of Patent: Apr. 21, 2009

(54) OPERATING BUTTON DEVICE

(75) Inventor: Yan Liu, Dong-Guan (CN)

(73) Assignee: Asia Optical Co., Inc., Taichung (TW)

( * ) Notice: Subject to any disclaimer, the term of this patent is extended or adjusted under 35 U.S.C. 154(b) by 49 days.

(21) Appl. No.: 11/803,987

(22) Filed: May 16, 2007

(65) Prior Publication Data

US 2008/0041706 A1 Feb. 21, 2008

(30) Foreign Application Priority Data

Aug. 15, 2006 (TW) ..... 95129914 A

(51) Int. Cl.
*H01H 3/40* (2006.01)

(52) U.S. Cl. ..... 200/500; 200/6 R; 200/339; 345/184; 340/502

(58) Field of Classification Search ..... 200/500, 200/553, 557, 302.3, 6 R, 61.76, 1 R, 18, 200/339; 345/156, 184; 340/502–504
See application file for complete search history.

(56) References Cited

U.S. PATENT DOCUMENTS

| | | | | |
|---|---|---|---|---|
| 5,412,165 | A * | 5/1995 | Malone et al. | 200/5 R |
| 6,255,610 | B1 * | 7/2001 | Botz et al. | 200/315 |
| 6,525,283 | B2 * | 2/2003 | Leng | 200/339 |
| 6,573,464 | B2 * | 6/2003 | Yen | 200/6 A |
| 6,812,415 | B1 * | 11/2004 | Priesemuth | 200/5 R |
| 6,852,938 | B2 * | 2/2005 | Nakade | 200/200 |

* cited by examiner

*Primary Examiner*—Kyung Lee
(74) *Attorney, Agent, or Firm*—Trop, Pruner & Hu, P.C.

(57) ABSTRACT

An operating button device of the present invention is adapted for use with an electronic apparatus, and includes first and second operating button sets and an elastic component. The first operating button set includes a mounting seat and a pair of press buttons disposed on the mounting seat. The second operating button set includes a toggle button rotatable relative to the mounting seat, and a pair of contact pieces disposed on a bottom part of the toggle button. The elastic component has a securing end disposed on the mounting seat, and a restoring end opposite to the securing end and in sleeving engagement with the toggle button.

4 Claims, 8 Drawing Sheets

OPERATING BUTTON DEVICE

CROSS-REFERENCE TO RELATED APPLICATION

This application claims priority of Taiwanese Application No. 095129914, filed on Aug. 15, 2006.

BACKGROUND OF THE INVENTION

1. Field of the Invention

The invention relates to an operating button device, for an electronic apparatus.

2. Description of the Related Art

An electronic apparatus, such as a digital camera and a digital video camera, is usually provided with an operating button device. As shown in FIGS. 1, 2, and 3, a user can use the operating button device 2 to control functions such as zoom adjustment and menu selection of a digital camera 1. The camera 1 includes a circuit 11 and switches 12 disposed on the circuit 11. The conventional operating button device 2 includes first and second operating button sets 21, 22. The first operating button set 21 includes a mounting seat 211, a pair of press buttons 212 disposed on two sides of the mounting seat 211, respectively, and an elastic plate 213 in a form of a continuous S-shape and connected to two ends of the mounting seat 211. The second operating button set 22 includes a toggle button 221 disposed on the elastic plate 213 of the first operating button set 21, and a pair of contact pieces 222 disposed on two sides of a bottom part of the toggle button 221, respectively.

When the user operates the toggle button 221, it will rotate relative to the mounting seat 211, thereby deforming the elastic plate 213 and driving one of the contact pieces 222 to actuate a corresponding switch 12 of the camera 1 so that the relevant function of the camera 1 will be activated. When the user releases the toggle button 221, the elastic plate 213 will restore to its normal state, thereby driving the toggle button 221 to its original position.

However, since the first operating button 21, which includes the elastic plate 213 having a complex S-shaped design, is formed integrally from plastic, the elastic plate 213 is liable to suffer from elastic fatigue and even fracture after long-term use, thereby resulting in a relatively short service life. In addition, the restoring force of the elastic plate 213 is inadequate and the touch sensation when operating the toggle button 221 is not satisfactory. Moreover, the size of the elastic plate 213 is relatively large, which goes against the trend toward miniaturization in the design of electronic apparatus.

SUMMARY OF THE INVENTION

Therefore, the object of the present invention is to provide an operating button device that is durable, small and has a good touch sensation.

Accordingly, an operating button device of the present invention is adapted for use with an electronic apparatus that includes a main body, a pair of spaced apart first switches disposed on the main body, and a pair of second switches disposed between the first switches. The operating button device comprises first and second operating button sets, and an elastic component.

The first operating button set includes a mounting seat and a pair of press buttons disposed on the mounting seat so as to be adapted to correspond respectively in position to the first switches. The second operating button set includes a toggle button rotatable relative to the mounting seat and has a bottom part, and a pair of contact pieces disposed on the bottom part of the toggle button so as to be adapted to correspond respectively in position to the second switches. The elastic component has a securing end disposed on the mounting seat, and a restoring end opposite to the securing end and in sleeving engagement with the toggle button.

Use of the elastic component in the operating button device of this invention can result in a narrower width than that of the elastic plate of the prior art. Moreover, since the structure of the elastic component is simpler and stronger than that of the plastic S-shaped elastic plate of the prior art, the elastic component is more durable and has a longer service life. Furthermore, the restoring force of the elastic component is much stronger than that of the elastic plate of the prior art, thereby resulting in better touch sensation when operating the toggle button.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
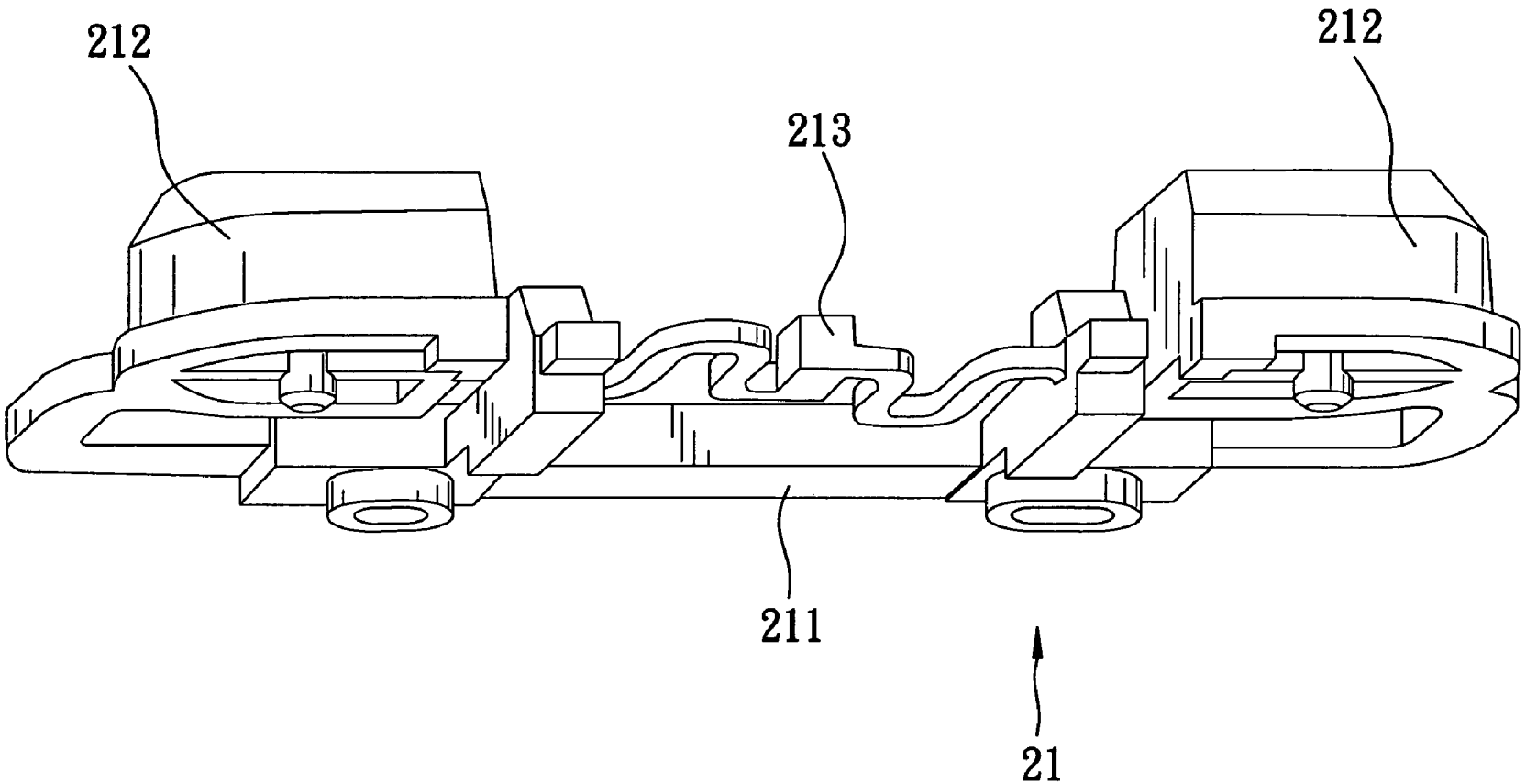
FIG. 1 PRIOR ART
FIG. 1 is a perspective view of a first operating button set of a conventional operating button device.
Figure 2:
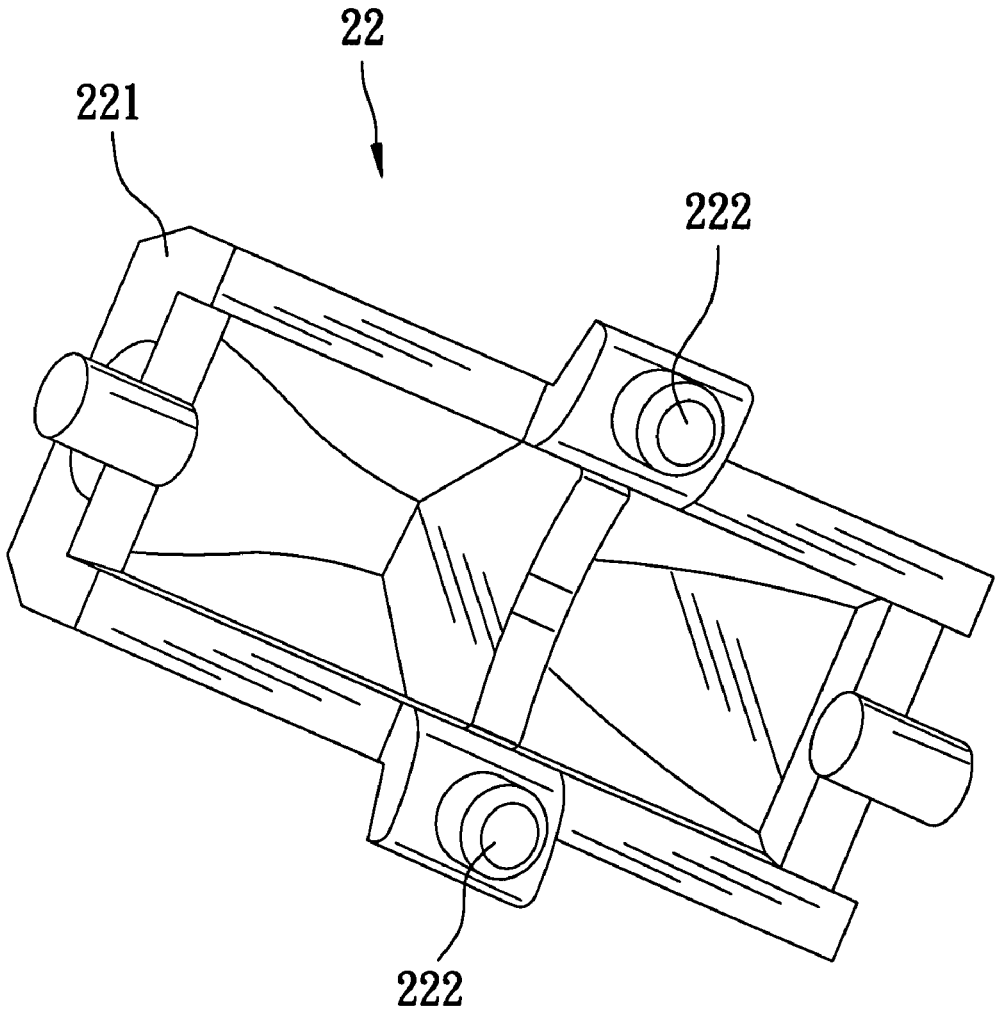
FIG. 2 PRIOR ART
FIG. 2 is a perspective view of a second operating button set of the conventional operating button device.
Figure 3:
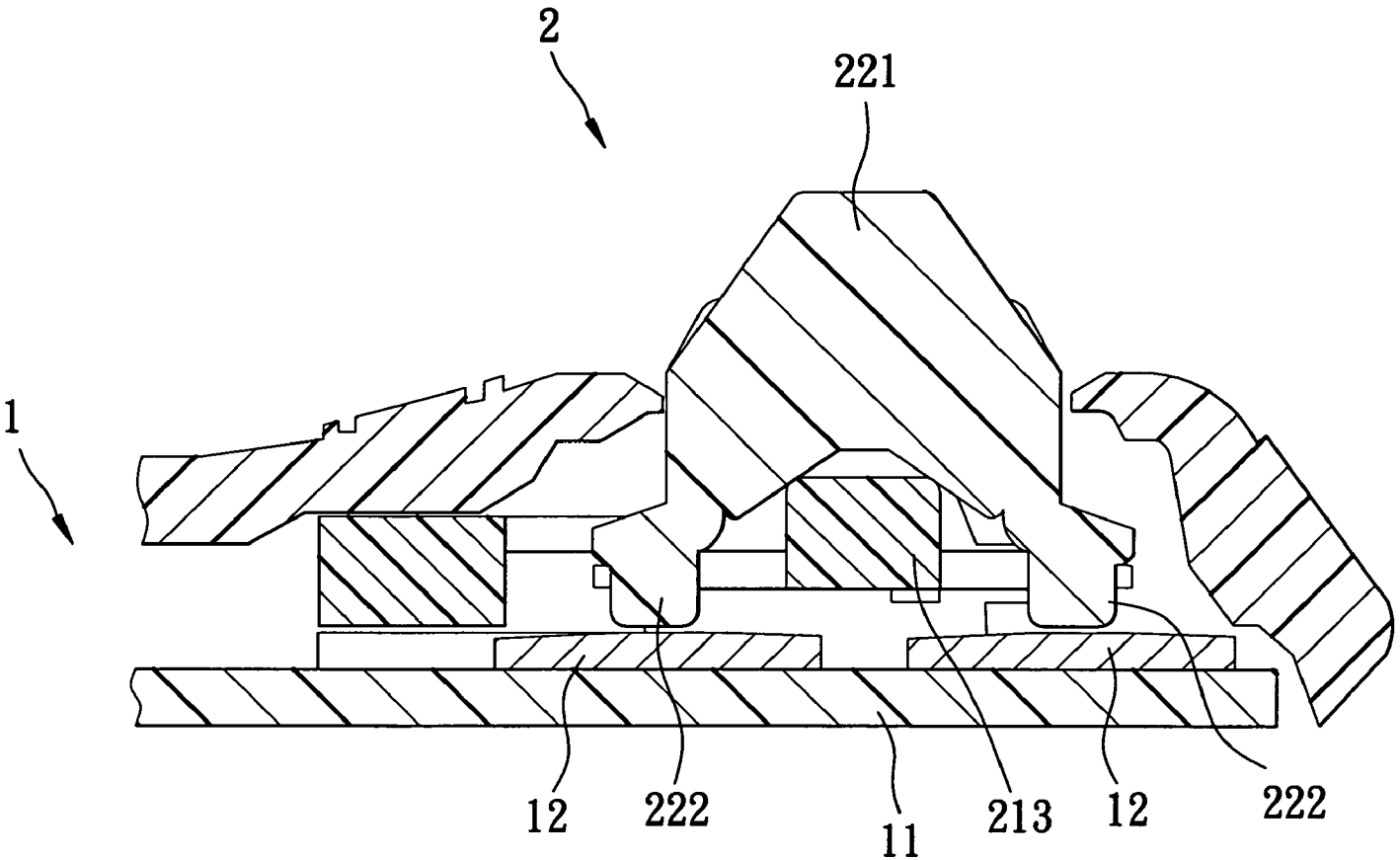
FIG. 3 PRIOR ART
FIG. 3 is an assembled sectional view of the conventional operating button device.
Figure 4:
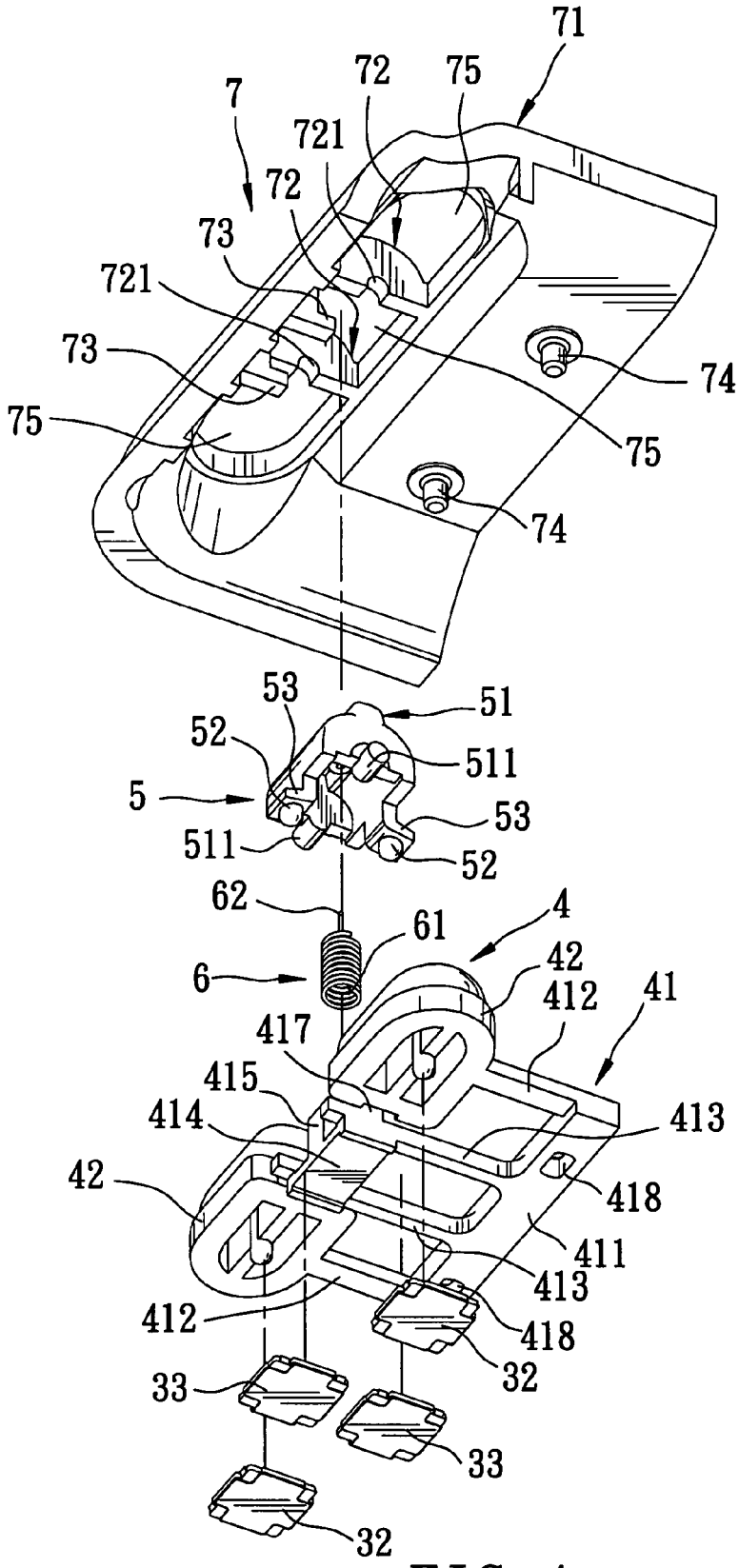
FIG. 4 is an exploded perspective view of a preferred embodiment of an operating button device according to the invention.
Figure 5:
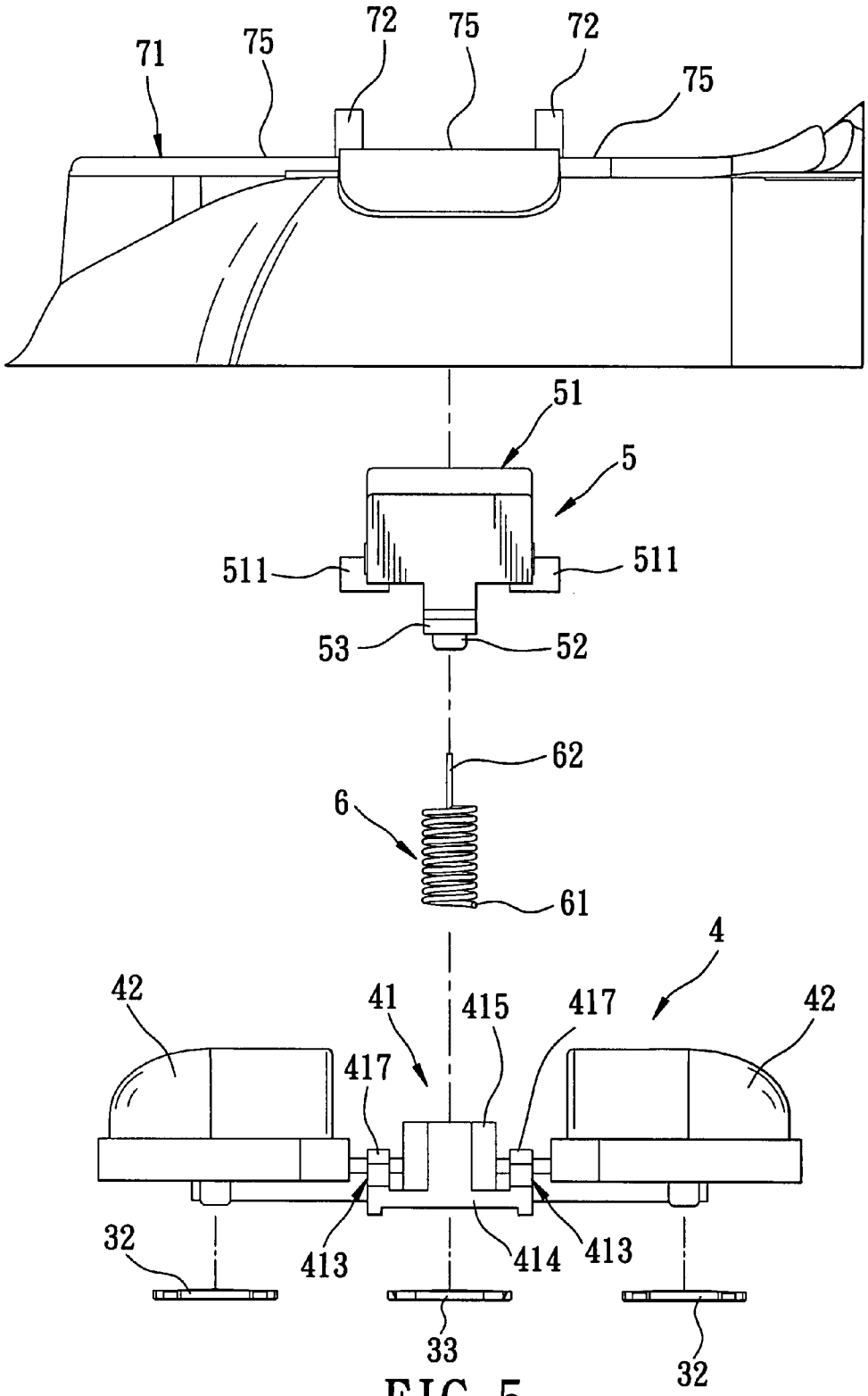
FIG. 5 is an exploded front view of the preferred embodiment.
Figure 6:
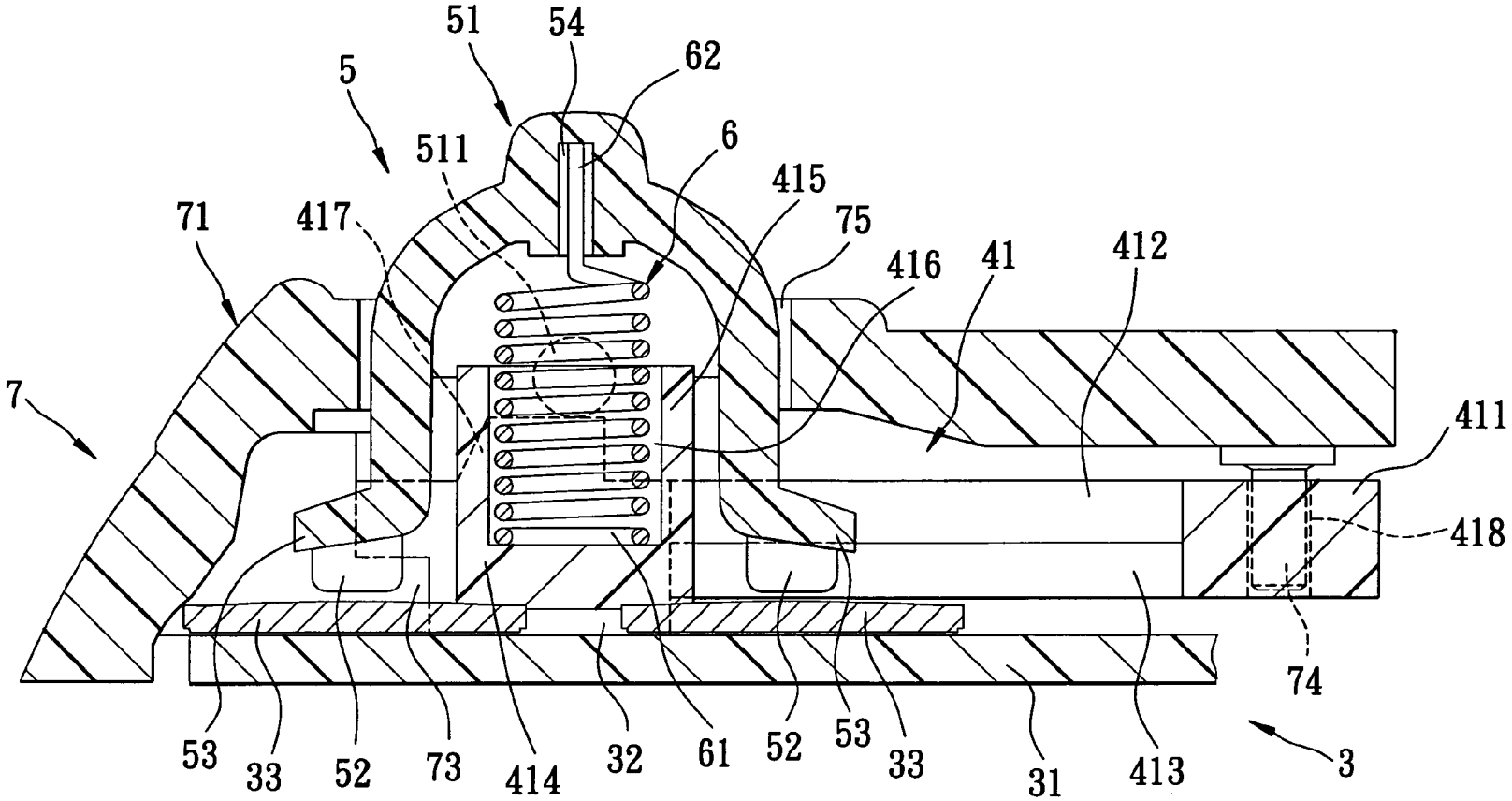
FIG. 6 is an assembled sectional view of the preferred embodiment, illustrating a toggle button in a restoring position.

As shown in FIGS. 4, 5, and 6, the preferred embodiment of an operating button device according to the present invention is adapted for use with an electronic apparatus. In this preferred embodiment, the electronic apparatus is exemplified as a camera 3 including a main body 31, a pair of spaced apart first switches 32 disposed on the main body 31, and a pair of second switches 33 disposed between the first switches 32. The operating button device comprises first and second operating button sets 4, 5, an elastic component 6, and a covering frame 7.

The first operating button set 4 includes a mounting seat 41 and a pair of press buttons 42 disposed on the mounting seat 41 so as to be adapted to correspond respectively in position to the first switches 32 of the camera 3. The mounting seat 41 includes a base plate 411 adapted to be disposed on the main body 31 of the camera 3, a pair of cantilever rods 412 each extending from the base plate 411 to a respective one of the press buttons 42, a pair of connecting rods 413, a bottom wall 414 disposed between the connecting rods 413, and a surrounding wall 415 formed on the bottom wall 414.

The second operating button set 5 includes a toggle button 51 rotatable relative to the mounting seat 41 and having a bottom part 53, and a pair of contact pieces 52 disposed on the bottom part 53 of the toggle button 51 so as to be adapted to correspond respectively in position to the second switches 33 of the camera 3.

The elastic component 6 has a securing end 61 disposed on the mounting seat 41 of the first operating button set 4, and a restoring end 62 opposite to the securing end 61 and in sleeving engagement with the toggle button 51 of the second operating button set 5. The surrounding wall 415 of the mounting seat 41 defines a receiving space 416 for receiving the securing end 61 of the elastic component 6. In the preferred embodiment, the elastic component 6 is a spring, and the restoring end 62 is in a form of a straight rod. Besides, the toggle button 51 is formed with a coupling hole 54 for insertion of the restoring end 62 therein.

The covering frame 7 includes a hollow frame body 71, and a pair of partition plates 72 disposed in and cooperating with the frame body 71 to define three access openings 75 for exposing the press buttons 42 and the toggle button 51, respectively. Each of the partition plates 72 has one end adjacent to the mounting seat 41 and formed with a notch 721. The toggle button 51 has a pair of pivot studs 511 extended into the notches 721 in the partition plates 72, respectively. In addition, each of the connecting rods 413 of the mounting seat 41 has a stop projection 417 that projects toward the notch 721 in a respective one of the partition plates 72 to position a respective one of the pivot studs 511 of the toggle button 51. The covering frame 7 further includes a pair of latching hooks 73 disposed on the frame body 71 between the press buttons 42 of the first operating button set 4. Each of the connecting rods 413 of the mounting seat 41 has one end disposed on the base plate 411 and an opposite end engaging a respective one of the latching hooks 73. The covering frame 7 further includes a plurality of positioning studs 74 that extend from the frame body 71 toward the mounting seat 41. The base plate 411 of the mounting seat 41 is formed with a plurality of positioning holes 418 to engage sleevingly and respectively the positioning studs 74.

Figure 7:
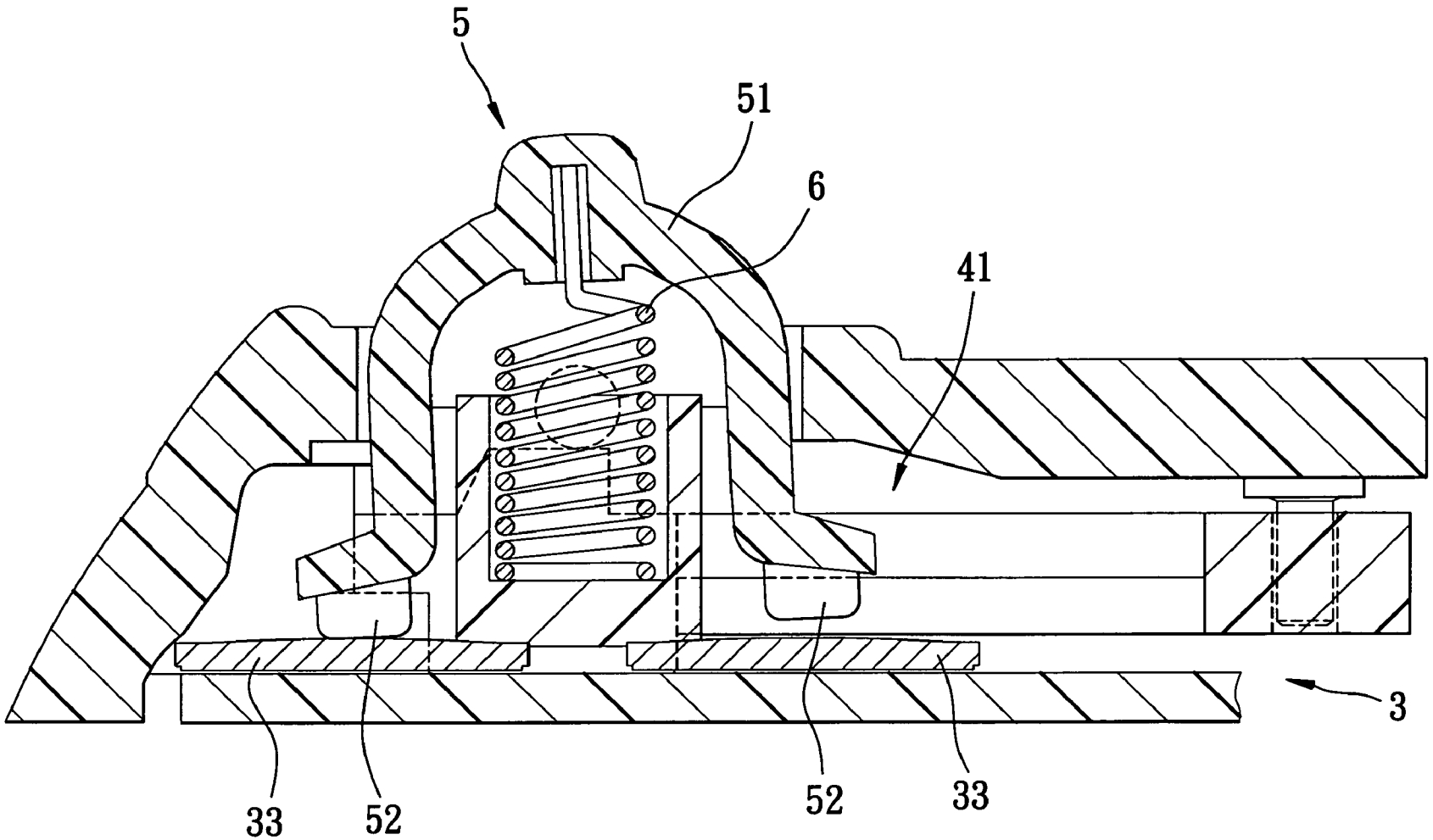
FIG. 7 is a view similar to FIG. 6, but illustrating the toggle button moved to a press position.
Figure 8:
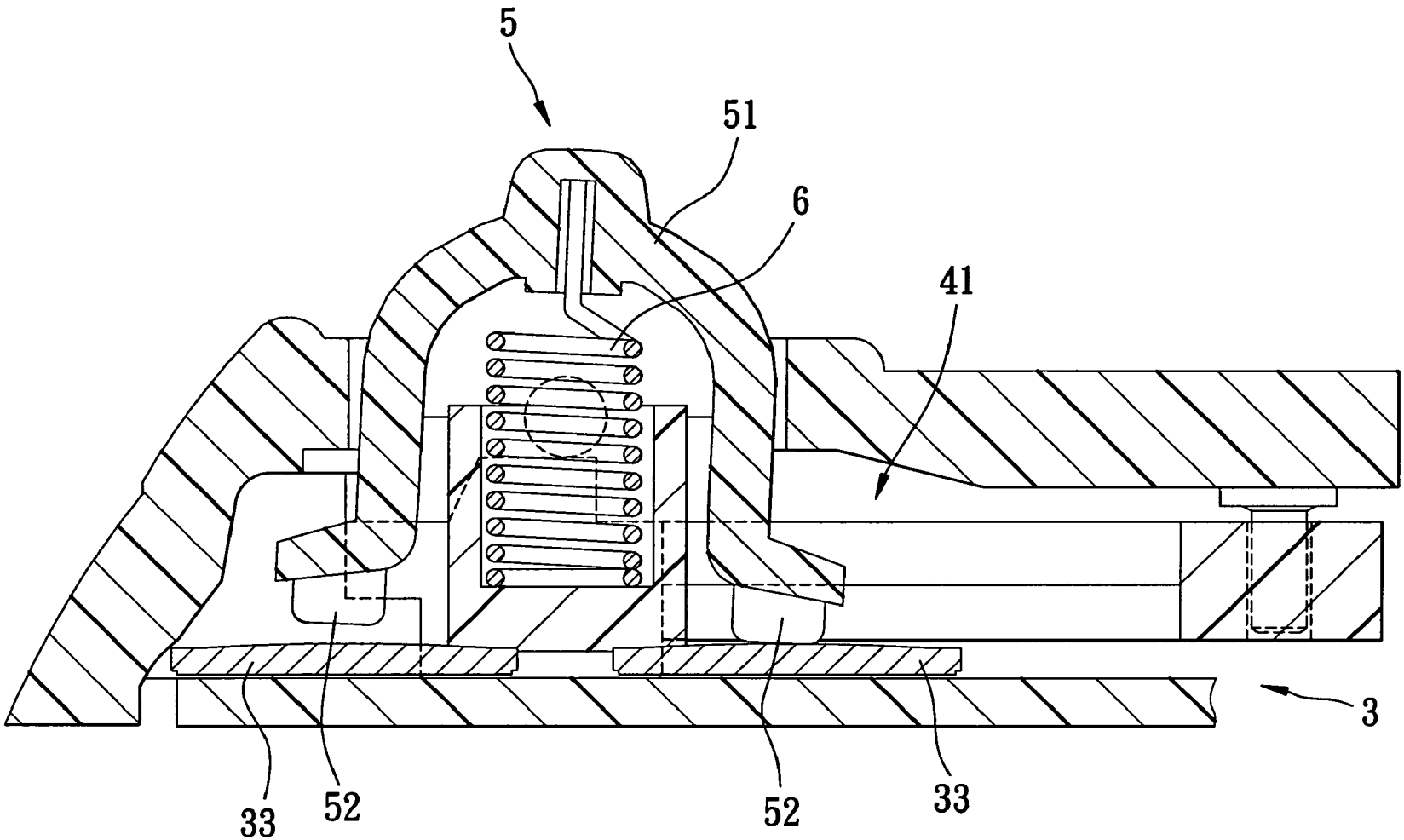
FIG. 8 is a view similar to FIG. 6, but illustrating the toggle button moved to another press position.

As shown in FIGS. 6, 7, and 8, the toggle button 51 of the second operating button set 5 is rotatable relative to the mounting seat 41 among a restoring position and two press positions. When the user has yet to press the toggle button 51 of the second operating button set 5, the toggle button 51 is at the restoring position, and the contact pieces 52 are spaced apart from the second switches 33 of the camera 3. Therefore, the function of zoom adjustment is not activated. On the other hand, when the user presses the toggle button 51 to rotate to either one of the press positions, the elastic component 6 will deform, and one of the contact pieces 52 will contact the corresponding second switch 33 of the camera 3 to activate the function of zoom adjustment. After the user completes the zoom adjustment and releases the toggle button 51, the elastic component 6 will restore to a normal state, thereby driving the toggle button 51 to rotate back to the restoring position, where the contact pieces 52 are once again spaced apart from the second switches 33.

Since the elastic component 6 is a spring according to the preferred embodiment, the structure thereof is simpler and stronger than the plastic S-shaped elastic plate 213 of the prior art, i.e., the elastic component 6 is more durable than the elastic plate 213 of the prior art. In addition, the restoring force of the elastic component 6 is much stronger than that of the elastic plate 213 of the prior art, thereby resulting in better touch sensation when operating the toggle button 51. Moreover, the width of the elastic component 6 is narrower than that of the elastic plate 213 of the prior art, so that the size of the operating button device is smaller than that of the prior art, which leads to a lighter and smaller camera.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An operating button device adapted for use with an electronic apparatus, the electronic apparatus including a main body, a pair of spaced apart first switches disposed on the main body, and a pair of second switches disposed between the first switches, said operating button device comprising:

a first operating button set including a mounting seat and a pair of press buttons disposed on said mounting seat so as to be adapted to correspond respectively in position to the first switches;

a second operating button set including a toggle button rotatable relative to said mounting seat and having a bottom part, and a pair of contact pieces disposed on said bottom part of said mounting seat so as to be adapted to correspond respectively in position to the second switches;

an elastic component having a securing end disposed on said mounting seat, and a restoring end opposite to said securing end and in sleeving engagement with said toggle button; and a covering frame including a hollow frame body, and a pair of partition plates that are disposed in and that cooperate with said frame body to define three access openings for exposing said press buttons and said toggle button respectively, each of said partition plates having one end that is adjacent to said mounting seat and that is formed with a notch, said toggle button having a pair of pivot studs that extended into said notches in said partition plates, respectively.

2. The operating button device as claimed in claim 1, wherein said covering frame further includes a pair of latching hooks disposed on said frame body between said press buttons, said mounting seat of said first operating button set including a base plate adapted to be disposed on the main body of the electronic apparatus, a pair of suspension rods each extending from said base plate to a respective one of said press buttons, a pair of connecting rods each having one end disposed on said base plate and an opposite end engaging a respective one of said latching hooks, a bottom wall disposed between said connecting rods, and a surrounding wall formed on said bottom wall, said surrounding wall defining a receiving space for receiving said securing end of said elastic component, each of said connecting rods having a stop projection that projects toward said notch in a respective one of said partition plates to position a respective one of said pivot studs of said toggle button.

3. The operating button device as claimed in claim 2, wherein said covering frame further includes a plurality of positioning studs that extend from said frame body toward said mounting seat, and said base plate of said mounting seat is formed with a plurality of positioning holes to engage sleevingly and respectively said positioning studs.

4. The operating button device as claimed in claim 1, wherein said elastic component is a spring, and said restoring end is in a form of a straight rod, said toggle button being formed with a coupling hole for insertion of said restoring end therein.

* * * * *